United States Patent [19]

Burch

[11] 4,268,813

[45] May 19, 1981

[54] RESETTABLE THERMAL CUT-OFF SWITCH

[75] Inventor: Hadley K. Burch, Pittsfield, Vt.

[73] Assignee: B/K Patent Development, Highland Park, Ill.

[21] Appl. No.: 76,339

[22] Filed: Sep. 17, 1979

[51] Int. Cl.[3] ..... H01H 61/00

[52] U.S. Cl. ..... 337/118; 337/155; 337/408

[58] Field of Search ..... 337/115, 118, 122, 314, 337/315, 402, 408, 411, 116

[56] References Cited

U.S. PATENT DOCUMENTS

| | | | |
|---|---|---|---|
| 3,212,337 | 10/1965 | McCarrick | 337/315 X |
| 3,444,355 | 5/1969 | Tyler | 337/411 X |
| 3,778,739 | 12/1973 | Burch | 337/155 X |
| 3,902,150 | 8/1975 | Wada et al. | 337/116 |
| 4,189,698 | 2/1980 | Hara | 337/408 X |

*Primary Examiner*—George Harris

*Attorney, Agent, or Firm*—Kenway & Jenney

[57] ABSTRACT

A pair of conductors in an electric switch are kept in electrical contact by a wire gripped between the conductors and a base against which the conductors are biased. A pedestal of meltable material in a well, covered by a resilient sheet, supports the base in its position. A spring urges the wire out of engagement with the conductors, and is successful when the pedestal melts and fails to support the base, the base meanwhile distorting the resilient sheet. After the disengagement of the wire from the conductors, the pedestal resolidifies in its original shape as the resilient sheet regains its configuration. A reset button is coupled to re-engage the wire with the conductors.

10 Claims, 7 Drawing Figures

RESETTABLE THERMAL CUT-OFF SWITCH

BACKGROUND OF THE INVENTION

The invention relates to thermal cut-off switches for electrically operated devices, and particularly to such switches that are resettable.

Many electrically operated tools and appliances should not be operated above certain temperatures because of the harm to users that can result or because of potential damage to the tool or appliance itself. The problem is particularly important for electrical heating appliances such as toasters and hair-treating appliances, where a minor malfunction of the unit's circuitry can lead to the dangerously excessive generation of heat. Accordingly such electrical appliances usually incorporate thermally triggered cut-off switches in the electric circuits supplying power to the devices. The switches cut off power to the device when a sensor reaches a pre-set temperature.

It is desirable to make such a switch as inexpensively as possible. The reliability of the switch is, nevertheless, the prime consideration. Since producing a thermal cut-off switch that is resettable usually requires additional elements and more careful manufacture, one solution to meeting the requirement for both economy and reliability is to produce a switch that operates just once. Such a solution is presumably based on the assumption that most devices do not overheat, and that if they do and the switch is "used up" in cutting off power, the device will require repair and replacement of the switch can be part of the repair. Making the switch reusable is desirable if it must be reset often, or if it can be produced as economically and reliably as a non-resettable switch.

A common kind of thermal cut-off switch includes connecting elements that are biased apart but are held together by an arrangement of elements dependent on the solidification of metable material. When a hazardous temperature is reached the meltable material liquifies and the connecting elements are dis-engaged. See, e.g., U.S. Pat. No. 3,820,050. In single use switches, such as the one shown in that patent, the meltable material is dissipated when it melts and no reset function is provided. In resettable switches, it is necessary to devise an arrangement that preserves the meltable material and provides for a re-establishment of the original switch arrangement. U.S. Pat. No. 3,444,355 shows an arrangement in which ratchets holding a disengagement plunger are kept from motion by solid fusible material securing the ratchets to their housing. The material seems to be contained in the housing so that if the material melts, allowing the ratchets to turn and release the plunger, when it later resolidifies, it secures the ratchets again and allows the plunger to be reset and held. An economical and efficient switch should have a less complicated arrangement, fewer parts, and a surer way of containing reusable meltable material so that it can be used again and again, than shown in these examples of the prior art.

Accordingly, it is an object of the invention to provide a thermally operated electrical cut-off switch in which a mass of meltable material plays the active role, that is economical to make, reliable in action, and resettable.

Other objects of the invention will in part be obvious and will in part appear hereinafter.

SUMMARY OF THE INVENTION

The switch of the invention includes two contact elements kept in contact by one element gripping the other in cooperation with a base against which the first element is biased. A contained pedestal of meltable material, part of the container for it including a resilient sheet, supports the base in its position. The contact elements are urged apart from each other, and do come apart, when the pedestal melts and fails to support the base. The shape of the pedestal and the shape of the resilient wall are distorted by the base during the disengagement. After the disengagement is completed, the resilient wall and the pedestal return to their original configuration, in which resolidification can occur, thereby providing a sure restoration of the meltable pedestal to its original shape in solid form. A reset button is arranged to then re-engage the connectors.

In preferred forms the base has a conical head against which one contact element holds the other, and the base is mounted in a resilient holder. The bottom of the base abuts a resilient sheet covering a container in the switch housing containing the meltable pedestal. Thus an economical, resettable, thermally activated switch is provided with a simply assembled minimum number of parts.

BRIEF DESCRIPTION OF THE DRAWINGS

For a fuller understanding of the nature and object of the invention, reference should be made to the following detailed description and the accompanying drawings, in which.

DESCRIPTION OF A PREFERRED EMBODIMENT

Figure 1:
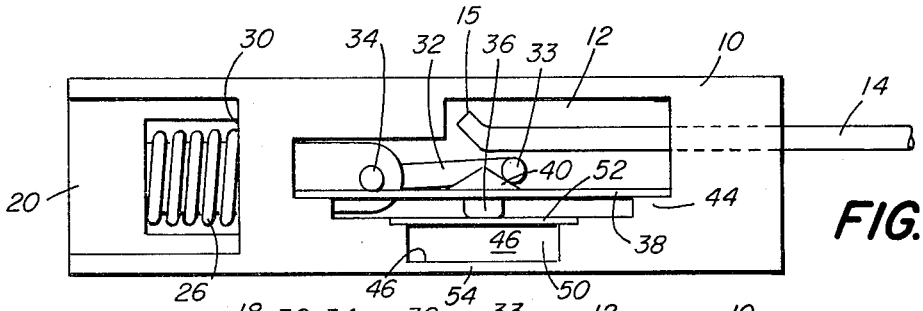
FIG. 1 is an elevational, sectional view of an assembly embodying the invention, showing it in a first mode in which the switch is closed.

FIGS. 1–4 show a switch for an electrical appliance, with an insulating housing 10 and an interior cavity 12. Extending into the interior cavity 12, through a pair of holes in one end of the housing 10, are a pair of parallel wire electrical conductors 14 and 16. The wires are coupled by means not shown to the appliance circuit in such a way that the appliance will operate only if the portions of the wires extending into the switch interior 12 are electrically coupled to each other. Each of the wire conductors 14 and 16 has a bent tip 15 and 17.

The other end of the housing 10 has a bore 18 in which is slidably seated a reset button 20 having a non-conductive shank 22. The button shank 22 extends into the switch interior 12 through a bore 24. A coil spring 26 is wrapped around the shank 22 and is compressed against the shoulder 30 formed by the bottom of the bore 22. A U-shaped conductive metal contact wire 32 in the switch interior 12 has two legs 33 and 34, one leg 34 being inserted through a hole 35 in the end of the reset button shank 22 extending into the interior.

A non-conductive holding base 36 is mounted in a flat resilient latch 38 in the switch interior 12. The base 36 has a conical head 40 attached to a shank 42 extending through the latch 38. The latch 38 is mounted on shoulders 44 formed in the interior of the housing 10.

The holding base 36 is mounted in the latch 38 directly over a well 46 formed in the housing 10. A pedestal of meltable material 50 entirely fills the well 46 which acts as a container for it, and a flat resilient wall 52, made out of a sheet of material such as silicone elastomer, forms a diaphragm covering the well 46. The resilient wall 52 is sealingly attached to the edges of the housing surrounding the well 46 to complete the containment of the meltable material 50. The holding base 36 is mounted in the latch 38 so that the bottom of the base shank 42 is supported by the resilient wall 52 covering the well of material 50. The well 46 is formed in the housing so that only a thin wall 54 separates the well 46 and the material 50 in it from the exterior of the housing.

FIG. 1 shows the elements of the switch arranged in a first mode, in which the material 50 is solid and the wire 33 provides an electrical connection between the wires 14 and 16 so that the electrical appliance controlled by the switch can operate. In this mode, the contact wire leg 33 of the U-shaped element 32 is held—against the urging of the reset button and spring 26—between the pair of wires 14 and 16 and the conical head 40 of the base 36. It is gripped there by virtue of the wires 14 and 16 functioning as cantilevered springs as they extend into the switch interior 12. The spring-like wires 14 and 16 grip the contact wire 33 in cooperation with the conical head 40 of the base 36, and the wire 33 provides electrical contact between the conductor wires 14 and 16. The pedestal 50 is solid and hence supports the base 36 through the wall 52.

The mass of material 50 is selected to melt at some predetermined temperature, based on a determination of the temperature at which further operation of the appliance controlled by the switch would be hazardous. The selection of a material that melts at the desired temperature is within the scope of the skill of those practicing the art. The outside wall 54 of the well 46 containing the material is arranged to be thin, so that the ambient heat surrounding the switch housing 10 can be rapidly transmitted to the material. Hence the pedestal 50 serves as a temperature sensor.

Figure 2:
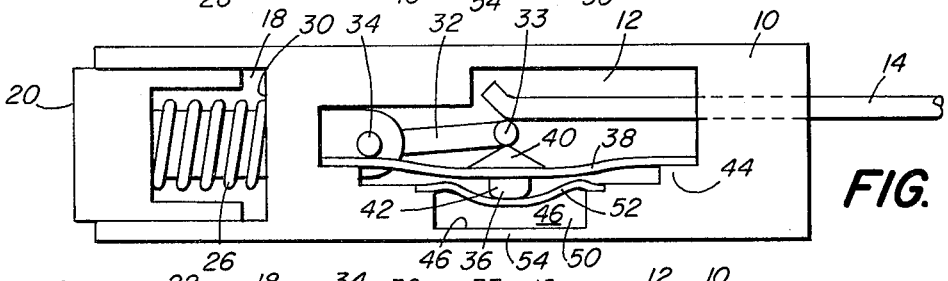
FIG. 2 is a similar view of the assembly, showing it in a second mode in which the switch is in the process of opening.

FIG. 2 shows the elements of the switch in a second mode, just after the ambient temperature has risen to the point where the meltable material 50 melts, going from a solid to a liquid form. When the meltable material 50 does melt, it fails to support the base 36 via the resilient wall 52 in position. The base shank 42 sinks down into the liquid material 50 as the result of forces exerted on the conical head 40 by the wire 33 and the conductors 14 and 16. The material remains contained, in its liquid state, in the well 46 by the resilient wall 52. Eventually, the base 36 sinks down far enough so that the gap between the conical head 40 and the conductors 14 and 16 is great enough to release the wire 33. The wire 33 then responds to the urging of the compressed coil spring 26 to move back from the contact it had with the conductors 14 and 16 with a fast snap action.

Figure 3:
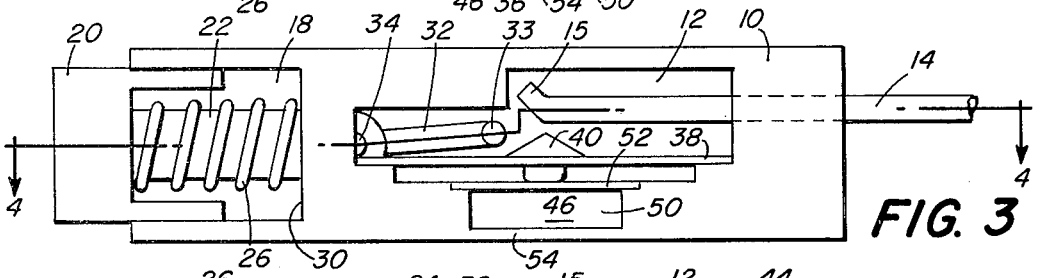
FIG. 3 is a similar view of the assembly, showing it in a third mode in which the switch is fully open.
Figure 4:
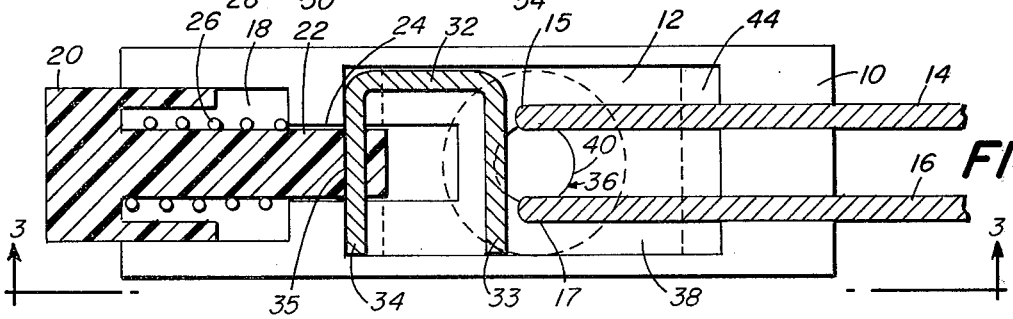
FIG. 4 is a plan sectional view of the assembly of FIG. 3, along the line 4—4 shown in FIG. 3.
Figure 5:
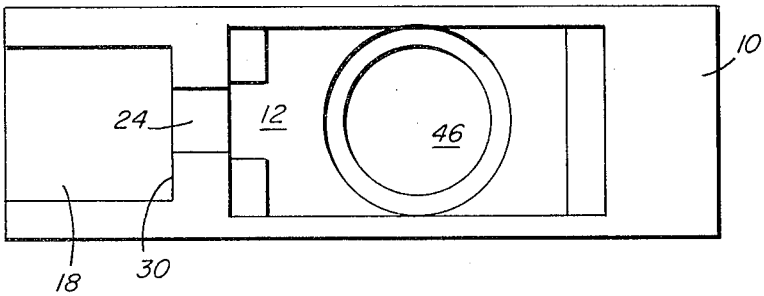
FIG. 5 is a plan view of the lower part of the assembly housing.
Figure 6:
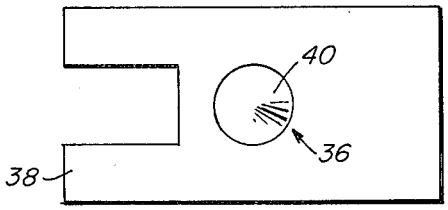
FIG. 6 is a plan view of a latch bearing a conical element that is part of the assembly.
Figure 7:
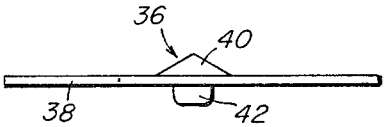
FIG. 7 is an elevational view of the latch shown in FIG. 6.

FIG. 3 shows the elements of the switch in a third mode, after the wire 33 and the conductors 14 and 16 are fully disengaged. The appliance is shut off. Any heat it generated dissipates, and the parts of the switch will cool to the ambient temperature. Under those circumstances, the resilient latch 38, which had been deformed by the movement of the base 36, returns to its former flat configuration. The resilient wall 52 also returns to its former flat configuration. Therefore when the temperature of the material 50 in liquid form drops below the melting point and the material resolidifies, it will become solid in the same form as it had in the first mode arrangement of the switch. Even after resolidification of the material 50, of course, the wire 33 and the conductors 14 and 16 will remain disengaged and the appliance controlled by the switch will remain inoperative.

Once the material 50 has resolidified, however, the switch may be restored to its first mode arrangement, as illustrated in FIG. 1, by pressing the reset button 20. Pressing reset button 20 urges the wire 33 back into the switch interior 12 against the bias of the coil spring 26. The wire 33 is guided by the conductor tips 15 and 17 which are formed to guide the wire toward the gap between the conductors and the conical head 40 of the base 36, then through the gap, and finally to the other side (as in FIG. 1). When the reset button 20 is released, the bias of the spring-like conductors 14 and 16 toward the conical head 40 of the base 36 will retain the contact wire 33 in a grip between them. The contact wire 33 will carry current between the conductors 14 and 16, and the electrical appliance will be operable.

In the use of the switch, the conductors 14 and 16 are placed in the circuit of an electric appliance in a way that coupling of the conductors in the interior of the switch is necessary for operability of the appliance. Normal use of the switch would be with the switch elements arranged in the first mode, as shown in FIG. 1, wherein the contact wire 33 electrically couples the conductors 14 and 16.

When the ambient temperature rises above the predetermined melting point of the material 50, the material will melt and contact wire 33 will be pulled away from the conductors, as shown in the second mode, illustrated in FIG. 2. In the third mode, shown in FIG. 3, which immediately follows the second mode, the switch is open since the conductors are still disconnected, the appliance is inoperable, and the material 50 has an opportunity to cool. When it is appropriate for the appliance to be operated again, the reset button of the switch may be pressed to close the switch. Thus the switch is repeatedly resettable without disassembly of the switch.

It will thus be seen that the objects set forth above, among those made apparent from the preceding description, are efficiently attained. Since certain changes may be made in the above construction without departing from the scope of the invention, it is intended that all matter contained in the above description or shown in the accompanying drawings shall be interpreted as illustrative and not in a limiting sense.

Having described the invention, what is claimed as new and secured by Letters Patent is:

1. A thermally operated, resettable, electrical switch assembly in which an electrical circuit is completed when first and second contact elements are in contact and is interrupted when the contact elements are disengaged, comprising:

a housing, a first contact element, a base element, a second contact element supported by said housing and biased toward said base element, and being adapted to contact said first contact element and to engage said first contact element between said second contact element and said base element, biasing means for urging said first and second contact elements apart, fusible material solid below a predetermined temperature and liquid above it, and containing means in said housing for containing said fusible material, at least a portion of said containing means being a resilient wall supportably abutting said base element, said fusible material filling said containing means, said assembly having a first, second and third mode, in said first mode, said fusible material being below said predetermined temperature and being solid, and said first contact element being engaged in contact with said second contact element between said second contact element and said base element, in said second mode, said fusible material being above said predetermined temperature and being liquid, and said first contact element being disengaged from said second contact element, in said third mode, said first contact element being disengaged from said second contact element, said fusible material being below said pre-determined temperature and being solid.

2. The assembly as claimed in claim 1 further including resetting means for moving said first contact element against the urging of said biasing means toward engagement of said first contact element by said second contact element and said base element.

3. The assembly as claimed in claim 2 in which said resetting means comprises an element slidably mounted in said housing and coupled to said first contact element.

4. The assembly as claimed in claim 1 in which said second contact element comprises a pair of spaced apart conductors and said first contact element comprises a conductive element, said conductive element being contacted and engaged by both spaced apart conductors in said first mode arrangement of said assembly, whereby said conductors are electrically coupled.

5. The assembly as claimed in claim 1 in which said base element is mounted in a resilient support means mounted in said housing.

6. A thermally operated, resettable, electrical switch assembly including a housing in which first and second contact elements are urged away from each other, in which electrical coupling is made when said first and second contact elements are held in contact with each other against said urging, wherein the improvement comprises:

means of a predetermined configuration in said housing for containing a mass of material meltable at a pre-determined temperature, at least a portion of said means including a resilient wall, a mass of said material filling said containing means, means for holding said first and second contact elements in contact against said urging, when said holding means is in a first position in which it is supported by said resilient wall when said mass is in solid form, said resilient wall deforming when said mass first achieves liquid form, said holding means thereby moving to a second position in which it is not holding said first and second contact elements in contact, said resilient wall re-achieving its pre-determined configuration after said first and second contact elements are urged apart.

7. A thermally operated, resettable, electrical switch assembly in which electrical contact is made when first and second contact elements are in contact comprising:

a housing a first contact elements slidable in said housing, a second contact element springingly mounted in said housing, means of a predetermined configuration in said housing for containing a mass of material meltable at a pre-determined temperature, at least a portion of said means including a resilient wall, means for urging said first contact element from contact with said second contact element, and means for holding said first and second contact element in contact, said resilient wall supporting said holding means when said mass is solid, and not supporting said holding means when said mass is liquid, whereby when said mass is liquid said first and second contact elements are successfully urged apart, said resilient wall re-achieving its predetermined configuration when said first and second contact elements are apart.

8. The assembly of claim 7 in which said holding means comprises a portion defining a conical surface against which said second contact element is spring biased, and a portion of said first contact element may be held between said conical surface and said second contact element.

9. A thermally operated, resettable, electrical switch assembly comprising:

an electrically insulating housing, a first contact element arranged in said housing for movement between a disconnect position and a connect position, and normally resiliently urged to said disconnect position, a base element arranged in said housing for movement between first and second positions, a second contact element mounted in said housing, and a pedestal element that is solid below a predetermined temperature and liquid above it, said housing defining a container for said pedestal element, including a resilient container wall portion, said pedestal arranged to support said base element in said first position when said pedestal is in solid form, wherein said assembly has:

a first mode in which said first contact element is in said connect position, said second contact element and said base element supported in said first position by said pedestal in solid form holding said first contact element in said connect position, a second mode in which said pedestal is in liquid form, said base element is in said second position, and said first contact element is in said disconnect position, and a third mode in which said pedestal is restored to solid form, said base element is in said first position, and said first contact element is in said disconnect position.

10. A thermally operated, resettable, electrical switch assembly comprising:

an electrically insulating housing, a base element with a conical surface resiliently mounted in said housing for movement between a first and second position, a pedestal of material meltable above a predetermined temperature, said housing defining a container filled by said pedestal, said container including a resilient wall portion, said pedestal supporting said base element in said first position when in solid form, a pair of electrical conductors mounted in said housing and extending toward said conical surface, said switch being closed when said electrical conductors are electrically coupled, and a contact element slidably mounted in said housing between a first position in which it is gripped between said conical surface and said pair of conductors, electrically coupling the conductors, and a second position in which it is disengaged from said conductors, said contact element being resiliently mounted and urged toward said second position, wherein said assembly has:

a first mode in which said contact element is gripped between said conical surface and said pair of conductors, said pedestal being solid, a second mode in which said pedestal is liquid, said base element is in said second position, and said first contact element is movable toward its said second position, and a third mode in which said pedestal is resolidified into its original configuration, said base is resiliently restored to its first position, and said contact element is in said second position.

* * * * *